US010398242B2

(12) United States Patent
Bonney et al.

(10) Patent No.: US 10,398,242 B2
(45) **Date of Patent: *Sep. 3, 2019**

(54) OVERWRAP CONTAINER, METHOD OF AND APPARATUS FOR PRODUCING SAME

(71) Applicant: Paper Machinery Corporation, Milwaukee, WI (US)

(72) Inventors: Mark Jerome Bonney, Waukesha, WI (US); Chris George Ubl, New Berlin, WI (US); James Jerome Fritz, West Bend, WI (US)

(73) Assignee: Paper Machinery Corporation, Milwaukee, WI (US)

( * ) Notice: Subject to any disclaimer, the term of this patent is extended or adjusted under 35 U.S.C. 154(b) by 528 days.

This patent is subject to a terminal disclaimer.

(21) Appl. No.: 14/927,598

(22) Filed: Oct. 30, 2015

(65) Prior Publication Data

US 2017/0119183 A1 May 4, 2017

(51) Int. Cl.
*A47G 19/22* (2006.01)
*B65D 3/22* (2006.01)
(Continued)

(52) U.S. Cl.
CPC ..... *A47G 19/2288* (2013.01); *B31B 50/10* (2017.08); *B31B 50/322* (2017.08);
(Continued)

(58) Field of Classification Search
CPC ..... B65D 3/22; B65D 3/06; B65D 81/3869; A47G 19/228
See application file for complete search history.

(56) References Cited

U.S. PATENT DOCUMENTS 5,547,124 A 8/1996 Mueller
6,196,454 B1 3/2001 Sadlier
(Continued)

FOREIGN PATENT DOCUMENTS

DE 8301046 U1 5/1983
EP 1227043 6/2004
(Continued)

OTHER PUBLICATIONS

International Search Report for PCT/EP2006/008753 dated Jan. 15, 2007.

(Continued)

*Primary Examiner* — Andrew T Kirsch
*Assistant Examiner* — Don M Anderson
(74) *Attorney, Agent, or Firm* — Andrus Intellectual Property Law, LLP

(57) ABSTRACT

An overwrap container includes a base container having a first side seam on a side wall that extends along a longitudinal axis to define an internal volume, and a bottom connected to the side wall. An overwrap is positioned over the side wall of the base container and has a second side seam aligned longitudinally with the first side seam. Connecting elements are positioned between the side wall of the base container and the overwrap, and join the side wall of the base container and the overwrap together except in an area along the aligned first and second seams to define an uniform spacing extending continuously between the side wall and the overwrap forming an air gap there between.

15 Claims, 7 Drawing Sheets

(51) Int. Cl.

| | |
|---|---|
| ***B65D 81/38*** | (2006.01) |
| ***B65D 3/06*** | (2006.01) |
| ***B31B 50/62*** | (2017.01) |
| ***B31B 50/81*** | (2017.01) |
| ***B31B 50/10*** | (2017.01) |
| ***B31C 7/06*** | (2006.01) |
| ***B31B 50/32*** | (2017.01) |
| *B31B 105/00* | (2017.01) |
| *B31B 120/50* | (2017.01) |
| *B31D 5/00* | (2017.01) |
| *B31F 1/00* | (2006.01) |
| *B31B 50/00* | (2017.01) |
| *B31B 110/10* | (2017.01) |
| *B31B 110/20* | (2017.01) |

(52) U.S. Cl.

CPC ..... *B31B 50/62* (2017.08); *B31B 50/81* (2017.08); *B31C 7/06* (2013.01); *B65D 3/06* (2013.01); *B65D 3/22* (2013.01); *B65D 81/3869* (2013.01); *B31B 50/005* (2017.08); *B31B 50/622* (2017.08); *B31B 50/626* (2017.08); *B31B 2105/0022* (2017.08); *B31B 2110/10* (2017.08); *B31B 2110/20* (2017.08); *B31B 2120/50* (2017.08); *B31D 5/0086* (2013.01); *B31F 1/0093* (2013.01)

(56) References Cited

U.S. PATENT DOCUMENTS

| | | | |
|---|---|---|---|
| 7,686,753 | B2 | 3/2010 | Konzal |
| 7,717,325 | B2 | 5/2010 | Puls et al. |
| 8,146,796 | B2 | 4/2012 | D'Amato |
| 8,146,797 | B2 | 4/2012 | D'Amato |
| 8,387,857 | B2 | 3/2013 | Messerschmid |
| 8,393,886 | B2 | 3/2013 | D'Amato |
| 8,490,792 | B2 | 7/2013 | D'Amato |
| 8,608,018 | B2 | 12/2013 | Babinsky et al. |
| 8,794,294 | B2 | 8/2014 | D'Amato |
| 8,807,339 | B2 | 8/2014 | D'Amato |
| 8,932,428 | B2 | 1/2015 | D'Amato |
| 9,648,969 | B2 | 5/2017 | Fu et al. |
| 2005/0115975 | A1 | 6/2005 | Smith et al. |
| 2006/0237465 | A1 | 10/2006 | D'Amato |
| 2008/0264937 | A1 | 10/2008 | D'Amato |
| 2017/0340149 | A1* | 11/2017 | Morgan ..... A47G 19/2288 |

FOREIGN PATENT DOCUMENTS

| | | | |
|---|---|---|---|
| FR | 2533894 | A1 | 4/1984 |
| JP | 2000109144 | | 4/2000 |
| JP | 2000142834 | | 5/2000 |
| JP | 2004315065 | A | 11/2004 |
| JP | 2005263275 | | 9/2005 |
| WO | 2007028623 | A1 | 3/2007 |
| WO | 2007054179 | A2 | 5/2007 |
| WO | 2008042378 | | 4/2008 |

OTHER PUBLICATIONS

International Search Report for PCT/US2016/031733 dated Jul. 15, 2016.

Written Opinion of the International Search Report for PCT/US2016/031733 dated Jul. 15, 2016.

Office Action issued for Russian Application No. 2018119691, dated Dec. 13, 2018.

* cited by examiner

OVERWRAP CONTAINER, METHOD OF AND APPARATUS FOR PRODUCING SAME

FIELD

The present disclosure relates generally to thermally insulated containers, including cups, for storing hot and cold beverages and other consumable food products. More particularly, the present disclosure pertains to thermally insulated containers wherein the container or cup is configured with a double wall construction, and wherein an air gap is provided between the individual walls of the double wall construction.

BACKGROUND

The Assignee of the instant application, Paper Machinery Corporation of Milwaukee, Wis. U.S.A. is the manufacturer of paper cup making machines used to make a variety of cups and containers. A typical cup machine for making paper cups, for instance, includes a turret having a plurality of mandrels about which the containers are formed. The turret sequentially rotates the mandrels into cooperation with a variety of work stations where numerous cup forming procedures occur.

In an exemplary procedure, a circular bottom blank is cut out at one work station and attached to the end of a mandrel by a vacuum applied through the mandrel. During this procedure, the outside lip of the bottom blank is folded downwardly. At a subsequent work station, a side wall blank is wrapped around a mandrel. The side wall blank is heated and sealed using a seam clamp along an overlapped side seam which runs generally longitudinally along the side of the cup. Typically, a paperboard or solid plastic sheet is coated with a thermoplastic such as polyethylene, so the bottom and side wall blanks may be heated and sealed together. In some applications, the side wall blank includes a flap extending beyond the lip of the side wall blank, and this flap is bent over the lip. At a bottom finishing station, the flap is pressed against the lip from an inside recessed area of the bottom of the cup. By heating the polyethylene and firmly pressing the side wall flap and the bottom blank lip together, a bottom seal is formed and the cup is provided with a sturdy bottom region having a recessed area. There may also be other work stations where various other additional cup forming procedures are carried out. For example, one station may be used to provide a curl at the top or rim of the cup to provide a more functional drinking container and a better appearance.

Cups and containers produced according to the procedure outlined above typically do not have the ability to keep beverages and food products stored therein warm and, at the same time, protect the hand from becoming uncomfortable from holding a hot liquid or material. Similarly, such cups and containers do not have the ability to insulate a cold beverage or products and protect the exterior of the cold container from moisture condensation that may pool on the bottom of the container.

Many cups and containers have been produced with sleeves, overwraps or laminates to provide a thermally insulated double walled cup or container with an air gap between inner and outer walls to create hand-hold protection in addition to heat and cold retention in the beverage or food product contained therein.

In development of the present disclosure, the inventors have discovered that the air gap created between the inner and outer walls of the container is not always uniform therebetween. For example, it has been found that when applying an overwrap around a base cup or container, the air gap is substantially eliminated in the seam area formed by the overlapping opposite edges of the overwrap. This is due to the mechanical clamping which normally occurs along the length of the overwrap side seam. Such anomaly leads to the formation of a zone along the overwrap seam which makes the container or cup uncomfortable or inconvenient to hold relative to the remainder of the holding surface of the container or cup.

Accordingly, there remains a need to provide a double walled insulated container which overcomes the short comings of previous designs, and creates an overwrap container with a uniform air gap between the inner and outer walls of the container so as to ensure comfort of the holder of the overwrap container around its entire outer periphery. In addition, it is desirable to provide a method of and an apparatus for forming such an overwrap container.

SUMMARY

The present disclosure relates to an overwrap container including a base container having a first side seam on a side wall that extends about a longitudinal axis to define an internal volume, and a bottom connected to the side wall. An overwrap is positioned over the side wall of the basic container. The overwrap has a second side seam aligned longitudinally with the first side seam. Connecting elements are positioned between the side wall of the base container and the overwrap, and join the side wall of the base container and the overwrap together except in an area along the aligned first and second side seams to define a uniform spacing extending continuously between the side wall and the overwrap forming an air gap therebetween.

The present disclosure also relates to a method for producing an overwrap container comprising the steps of: a) providing a base container having a first side seam on a side wall that extends about a longitudinal axis to define an internal volume, and a bottom secured to the side wall; b) providing the side wall of the base container with connecting elements around an outer periphery of the side wall except for an area along the first side seam; and c) providing an overwrap having a second side seam over the side wall of the base container such that the first side seam of the base container and the second side seam are aligned together, and such that the overwrap is joined by the connecting elements to the outer periphery of the side wall of the base container except in an area along the first side seam to define an overwrap container having a uniform spacing extending continuously between the side wall of the base container and the overwrap.

The present disclosure further relates to an apparatus for producing an overwrap container including a first mechanized arrangement configured to provide a base container having a side wall and a bottom connected thereto, the side wall being formed with a first side seam extending longitudinally thereof. A second mechanized arrangement is connected with the first mechanized arrangement, is configured to provide a set of connecting elements on the side wall of the base container except along the length of the first side seam, and is configured to position an overwrap having a second side seam secured around the side wall of the base container such that the side wall of the base container is joined to the overwrap except along the length of the first side seam and such that the first and second side seams are aligned so as to define an overwrap container having a uniform air gap extending continuously between the sidewall of the base container and the overwrap.

BRIEF DESCRIPTION OF THE DRAWINGS

The drawings illustrate the best mode presently contemplated of carrying out the disclosure.

In the drawings.

DETAILED DESCRIPTION OF THE DRAWINGS

In the present description, certain terms have been used for brevity, clearness and understanding. No unnecessary limitations are to be applied therefrom beyond the requirement of the prior art because such terms are used for descriptive purposes only and are intended to be broadly construed. The different systems and methods described herein may be used alone or in combination with other systems and methods. Various equivalents, alternatives and modifications are possible within the scope of the appended claims. Each limitation in the appended claims is intended to invoke interpretation under 35 U.S.C. § 112, sixth paragraph, only if the terms "means for" or "step for" are explicitly recited in the respective limitation.

The drawings illustrate various aspects of the present disclosure including a machine for forming a base container or cup, a machine for providing adhesive on the base container and applying an overwrap around the base containers and a finished overwrap container.

Figure 1:
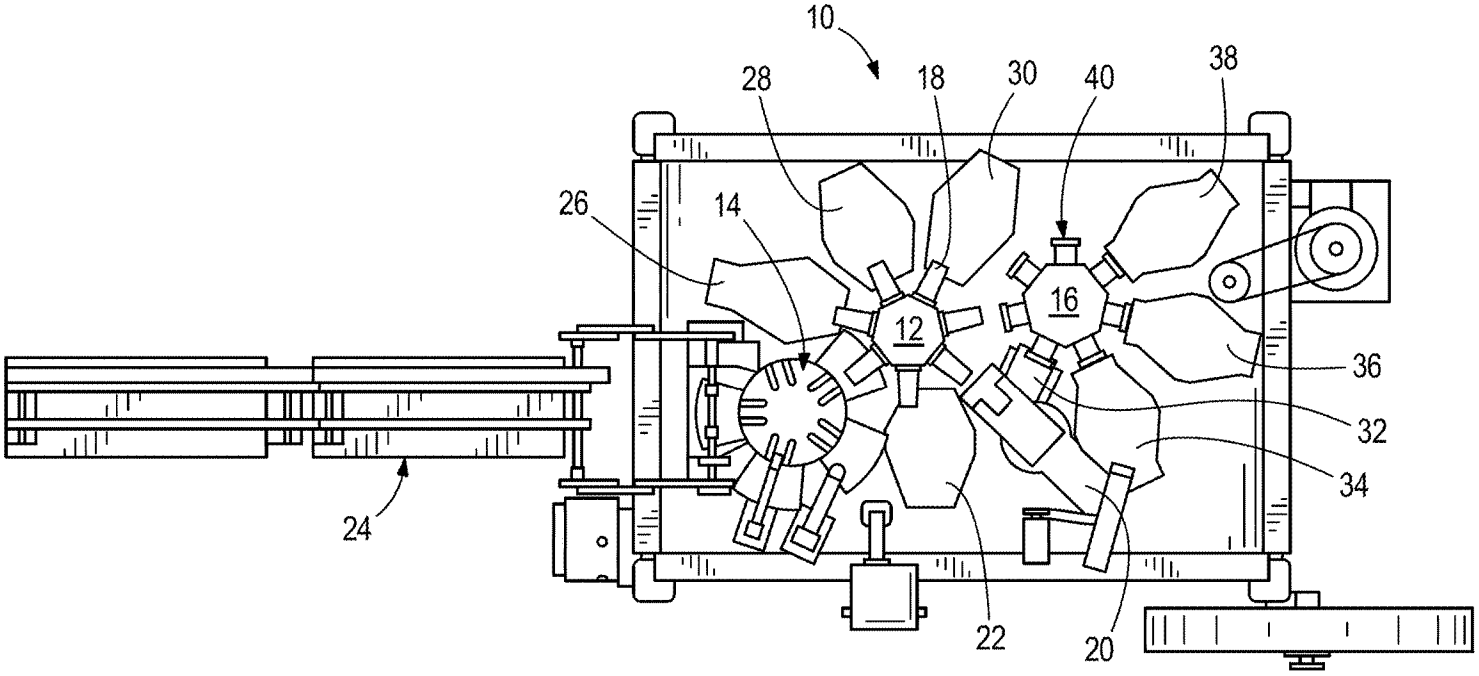
FIG. 1 is a schematic plan view of a cup making machine for making a base container or cup forming part of an overwrap container.

Referring generally to FIG. 1, an exemplary cup making machine or apparatus 10 is illustrated. This particular design includes a mandrel turret 12 which cooperates with a transfer turret 14 and a rimming turret 16. Mandrel turret 12 includes a plurality of frusto-conical mandrels 18 that are rotated in a stepwise or indexing manner between surrounding work stations. For example, a bottom blank may be applied to a given mandrel 18 at a bottom maker station 20 and then rotated to a bottom pre-heat station 22. From this point, the mandrel 18 is rotated into cooperation with the transfer turret 14 which receives generally trapezoidally shaped side wall blanks from a hopper 24, and rotates each side wall blank into cooperation with the cooperating mandrel 18. The side wall blank is then folded about the mandrel 18 over the bottom blank, heated and sealed along a seam.

Next, the bottom blank and the side wall blank are rotated to a bottom heat station 26. After heating, mandrel turret 12 indexes the subject mandrel 18 to a roller incurl station 28 where a portion of the side wall blank, i.e. a side wall blank flap, is bent over an outer lip of the bottom blank to form a recessed bottom in the cup. The cup is then moved to a bottom finishing station 30 where the side wall blank flap and the bottom blank lip are pressed against the lower region of the side wall blank to form a seal.

Figure 2:
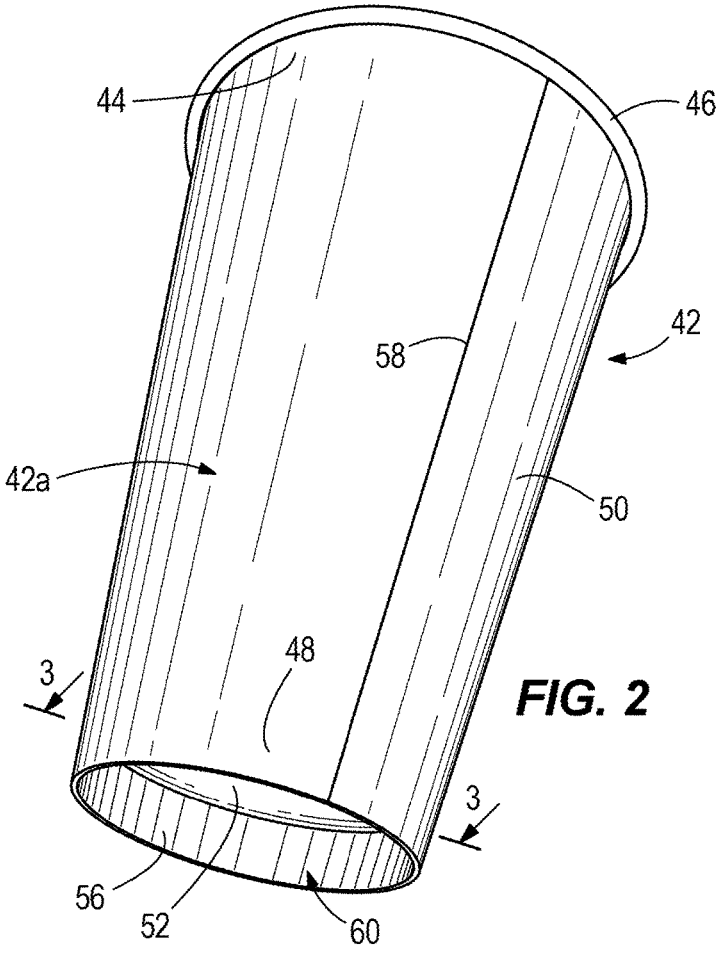
FIG. 2 is a bottom perspective view of a base container or cup produced from the machine shown in FIG. 1.

Once the bottom is formed and sealed, the cup is transferred to rimming turret 16 and rotated to a lube station 32 and then to a rimming precurl station 34 where the upper lip of the side wall is curled outwardly. From that station, the cup is indexed to a rimming finish curl station 36 which finishes the curled portion along the top of the cup to make an attractive edge. At this point, the cup may be moved to an optional lid groover station 38 and then to a cup blowout station 40 for removal of the finished cup depicted in FIG. 2 as a base container or cup 42 with a formed side wall 42*a* that extends about a longitudinal axis to define an internal volume.

The base container or cup 42 includes an upper region 44 having a curled rim 46 and a bottom region 48. Cup 42 is made from a side wall blank 50 disposed generally transverse thereto. A bottom blank 52 is typically bent or folded over in proximity to its outer edge to form a lip 54. The side wall blank 50 is located with respect to bottom blank 52 so that a flap portion 56 extends beyond lip 54. Flap portion 56 is bent or folded around lip 54 so lip 54 may be squeezed between flap portion 56 and a lower portion 57 of side wall blank 50 (see FIG. 3).

Figure 3:
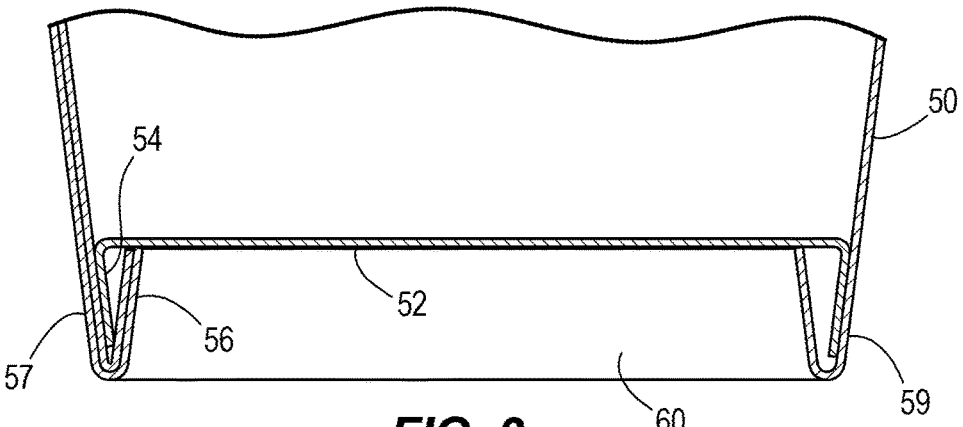
FIG. 3 is a sectional view taken on line 3-3 of FIG. 2.

The base container or cup 42 is typically made from paperboard blanks having a thermoplastic coating such as polyethylene. The thermoplastic material permits heating and sealing of adjacent components. For example, when side wall blank 50 is wrapped around bottom blank 52, the adjacent edges are heated and pressed together along a seam 58. The cup making machine 10 has the ability to create cups 42 with either a left over right seam or a right over left seam. Similarly, lip 54, flap portion 56 and lower portion 57 of side wall blank 50 may be heated and pressed together at bottom finishing station 30 to form a strong, leak-proof bottom region 48. By forming base cup 42 as illustrated in FIG. 3, a recessed area 60 is created in the bottom of cup 42 on an opposite side of blank 52 from the main container region of cup 42. Recessed area 60 in the bottom of the cup permits insertion of a tool to press lip 54 and flap portion 56 towards the lower region 57 of side wall blank 50.

Figure 4:
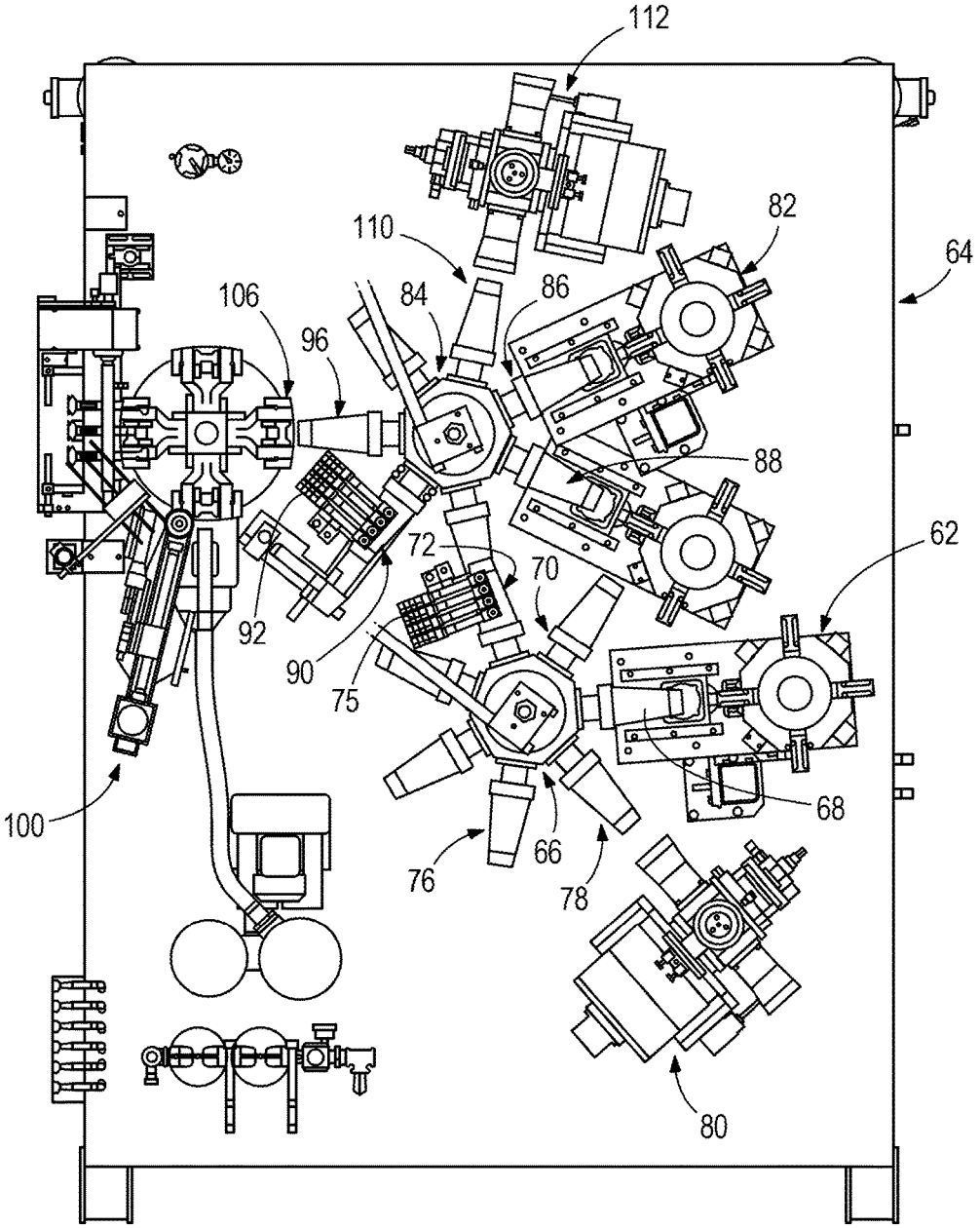
FIG. 4 is a schematic plan view of a cup making machine for applying adhesive elements to the base container or cup and for applying an overwrap thereto.
Figure 6:
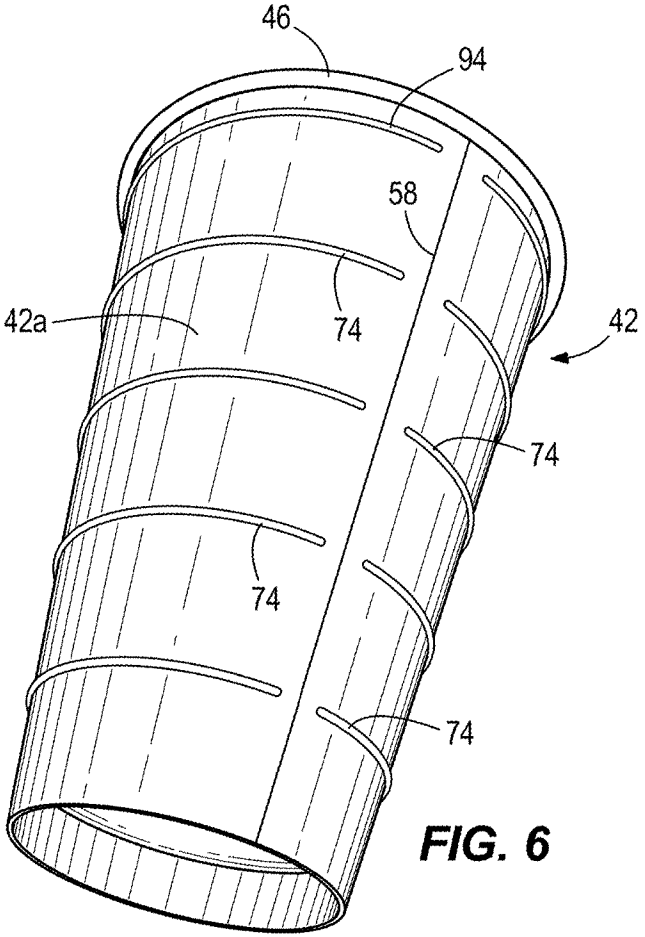
FIG. 6 is a view similar to FIG. 5 showing a second adhesive element applied to the base container or cup at a top edge.
Figure 5:
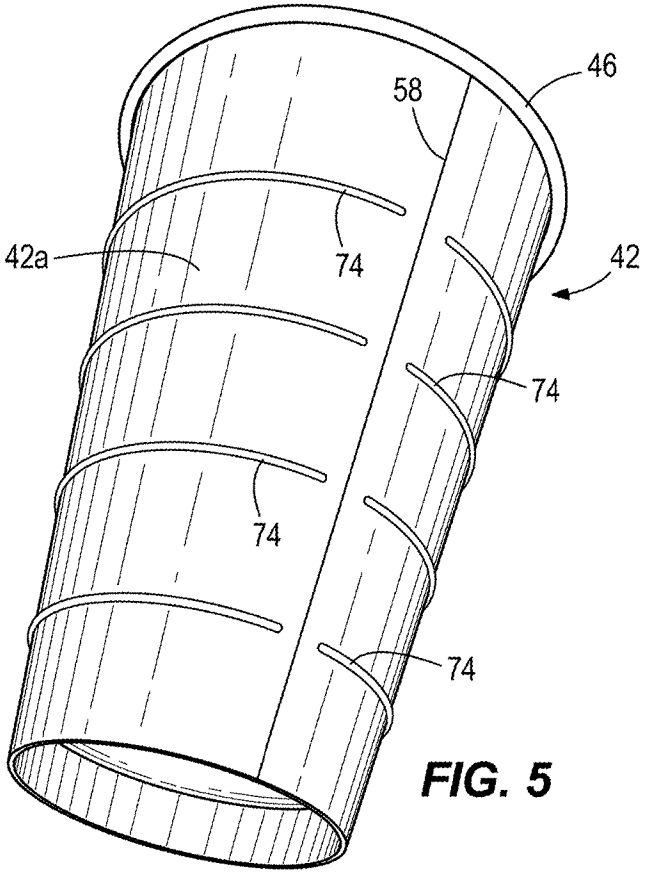
FIG. 5 is a view similar to FIG. 2 showing first adhesive elements applied to the base container or cup.

Referring now to FIG. 4, the base container or cup 42 is then transferred from the first machine apparatus 10 to a first cup feeder 62 on a second machine or apparatus 64. The first cup feeder 62 is aligned with a rotatable mandrel turret 66 which includes a plurality of rotary mandrels 68 that are rotated or indexed in a stepwise manner counterclockwise about a vertical axis to various rotary positions. For example, the finished base container or cup 42 is transferred by the cup feeder 62 onto a mandrel 68. Then the turret 66 is indexed one step to the rotary position at 70 where the base container 42 is rotated on the mandrel 68 about an axis perpendicular to the vertical turret axis so that the side seam 58 is orientated upwardly to a twelve o'clock position. The turret 66 is again indexed an additional step to bring the cup 42 on the mandrel 68 to the rotary position at 72 with the side seam 58 maintained in the twelve o'clock position. At this position, a plurality of spaced apart first adhesive elements (such as shown in 74 in FIG. 5) are initially applied circumferentially around the outer surface of the side wall 42*a* of the base container or cup 42 except in the area of the side seam 58 which is left blank. In a typical application, the first adhesive elements 74 take the form of a heated glue applied by a first radial glue apparatus 75 in elongated beads or ribs which when applied to the basic container 42 protrude outwardly therefrom and extend generally parallel to each other in equally spaced apart relationship. The adhesive elements 74 may take other forms and configurations as long as they are not formed in the vicinity of and along the side seam 58.

The base container 42 with the first adhesive elements 74 applied then indexes three steps to a position at 76 designated a cool down zone where the first adhesive elements or beads 74 cool and begin to harden. The base container 42 with the adhesive elements 74 is then indexed one step to the rotary position at 78 which is a blow off station at which the base container 42 is blown into an inverter turret 80. Alternatively, once the adhesive elements 74 have been initially applied to the base container 42 at position 72, the base container 42 can be indexed four steps directly to the blow off station at 78, it being understood that the adhesive beads 74 will cool and initially harden during the rotary travel from the position 72 to position 78.

Once the first adhesive elements 74 have been applied to the outer peripheral surface of the base container or cup 42, the inverter turret 80 is indexed accordingly to send the containers 42 to a second cup feeder 82 which is aligned with a rotatable mandrel turret 84. The mandrel turret 84 has a plurality of rotary mandrels 86 that are rotated or indexed in a stepwise manner clockwise about a vertical axis to various positions similar to turret 66. For example, the pre-glued base container or cup 42 is transferred by the cup feeder 82 onto a mandrel 86. Then, the turret 84 is indexed to a seam orientation station at 88 at which the pre-glued base container or cup 42 is rotated or spun on the mandrel 86 so that the side seam 58 on the side wall 42*a* of the pre-glued base container 42 is oriented upwardly to the twelve o'clock position. With the mandrel 86 held in position to maintain the twelve o'clock orientation of the side seam 58, the turret 84 is indexed to bring the pre-glued base container or cup 42 to a rotary position at 90. Here, a second radial glue apparatus 92 applies a second and final adhesive element (shown at 94 in FIG. 5) circumferentially around the outer surface of the base container or cup 42 beneath the curled rim 46 except in the area of the side seam 58 which is left blank. The second adhesive element 94 also takes the preferred form of an elongated bead or rib, which when applied to the top outer surface of base container or cup 42, protrudes outwardly therefrom and extends generally parallel to the first adhesive elements 74.

Figure 7:
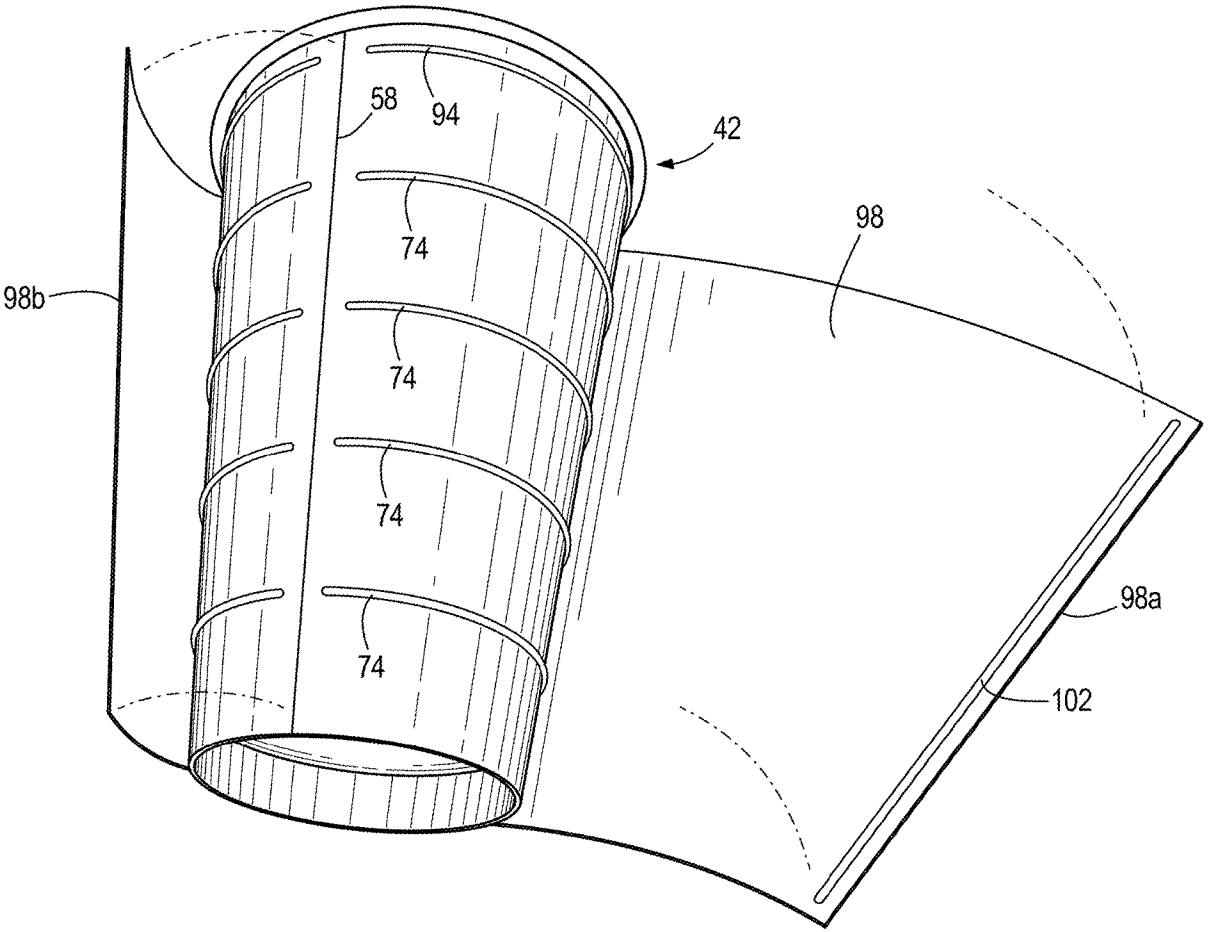
FIG. 7 is a view showing an overwrap about to be placed and secured around the base container or cup.

Once the adhesive elements 74, 94 have been applied, the base container or cup 42 is indexed clockwise to a position at 96 at which a pre-glued overwrap (seen at 98 in FIG. 7) is applied completely around the base container or cup 42. The overwrap 98 is a blank formed typically of paperboard, shaped similarly to and sized slightly smaller than the side wall blank 50 used in forming the base container or cup 50. The overwrap 98 is sized so that it lies between a top edge and a bottom edge of the base container 42. More particularly, the overwrap 98 has opposite side edges 98*a*, 98*b* one of which is provided by an applicator 100 along its length with an adhesive 102. The overwrap 98 is applied around the side wall 42*a* of the base container or cup 42 so that the inside surface of the overwrap 98 is connected to and spaced from the outside surface of the base container or cup 42 by means of the cooled adhesive elements 74, 94. At the same time, the edges 98*a*, 98*b* of the overwrap 98 are overlapped and joined or sealed together by the adhesive 102 to form an overwrap side seam 104 which is aligned with the base container side seam 58. The forming of the overwrap side seam 104 is made possible by a seam clamp 106 which applies a pressing or clamping force along the seam 104.

Figure 8:
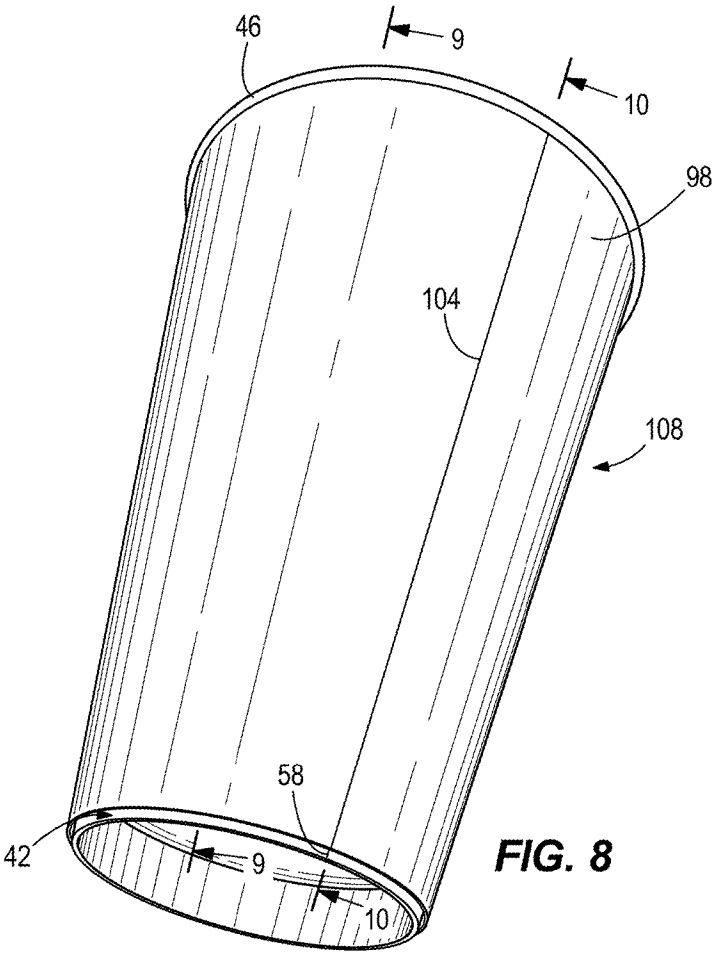
FIG. 8 is a bottom perspective view of a finished overwrap container.

With the joining of the overwrap 98 to the base container or cup 42, a finished overwrap container 108 (FIG. 8) is formed, and is indexed by the turret 84 to a position at 110. Here, the finished overwrap container 108 is blown off into a pocket of a second inverter turret 112 which is indexed to blow the overwrap container 108 to a cup stacker (not shown). The exemplary overwrap container 108 has a frustoconical shape with an open top and a closed bottom end. However, the present disclosure contemplates that the base container 42 and the overwrap 98 may be otherwise formed to provide a differently shaped overwrap container 108.

In the completed overwrap container 108, the base container or cup 42 forms an inner wall, and the overwrap 98 forms an outer wall, the inner and outer walls defining a double walled container. The inner and outer walls are connected together by the adhesive elements 74, 94 except in the overlapped areas of the side seams 58, 104. However, the adhesive elements 74, 94 function to space the inner and outer walls 42, 98 uniformly from each other completely throughout the entire overwrap container 104. Thus, the adhesive elements 74, 94 serve as both connecting and spacing elements.

Figure 9:
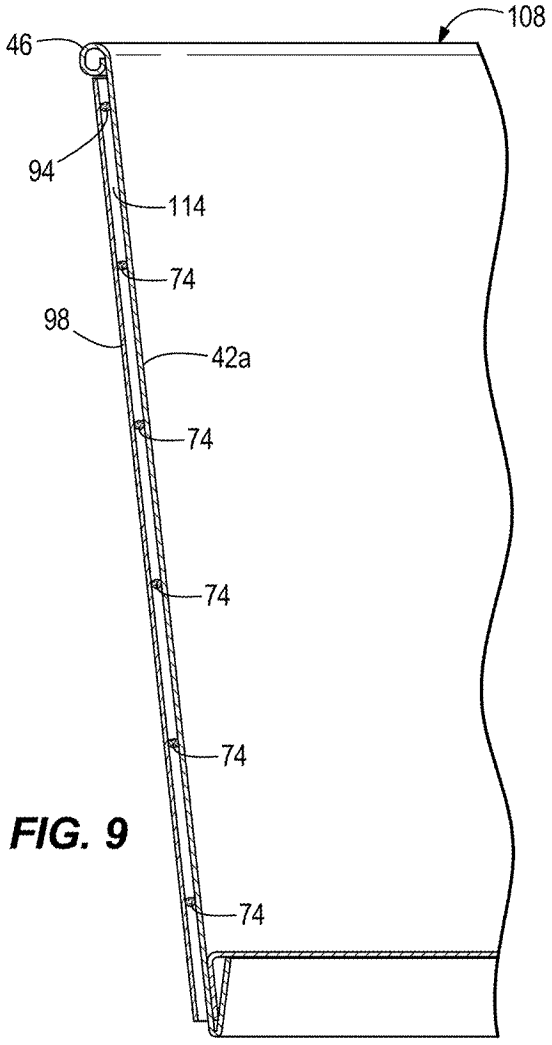
FIG. 9 is a sectional view taken on line 9-9 of FIG. 8 showing the adhesive elements between the base container or cup and the overwrap outside aligned side seams of the base container and the overwrap.
Figure 10:
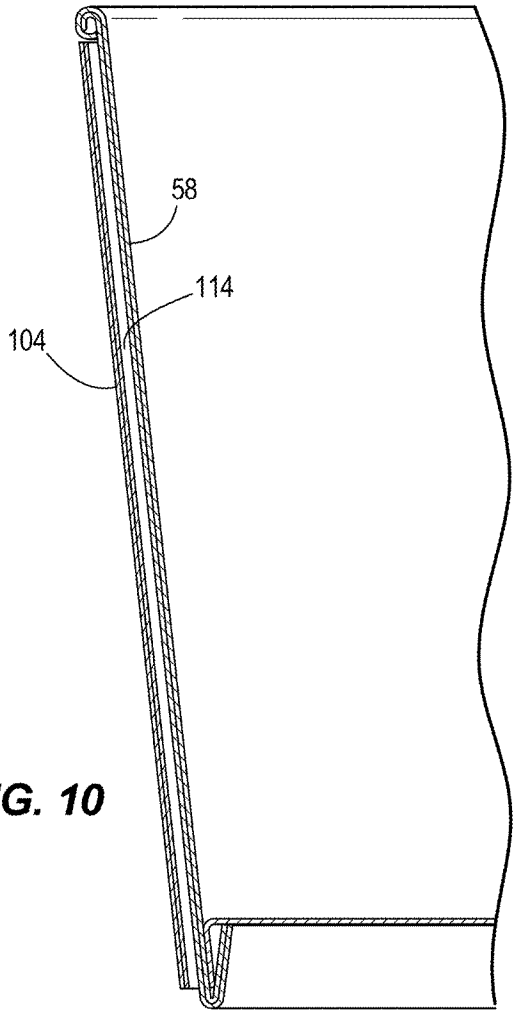
FIG. 10 is a sectional view taken on line 10-10 of FIG. 8 showing the absence of adhesive elements in the area of the aligned side seams of the base container and the overwrap.

FIGS. 9 and 10 illustrate different cross sections of the overwrap container 108 depicting the structural relationship of the base container or cup 42 and the overwrap 98 in the areas outside and within the side seam 58, and showing the existence of and the absence of, respectfully, the adhesive elements 74, 94.

It should be understood that the purpose of pre-gluing the adhesive elements 74, 94 on the base container of cup 42 is to eliminate any compression of the elements or beads 74, 94 during the wrapping process of the overwrap 98. The adhesive elements 74, 94 are designed to be hardened before the wrapping process occurs resulting in the uniform air gap 114 between the container 42 and the overwrap 98. In addition, the seams 58, 104 are aligned to obtain the desired uniform air gap 114 and to minimize any wrapping defects which might otherwise occur on adhesive elements if provided along the side seam 58.

Figure 11:
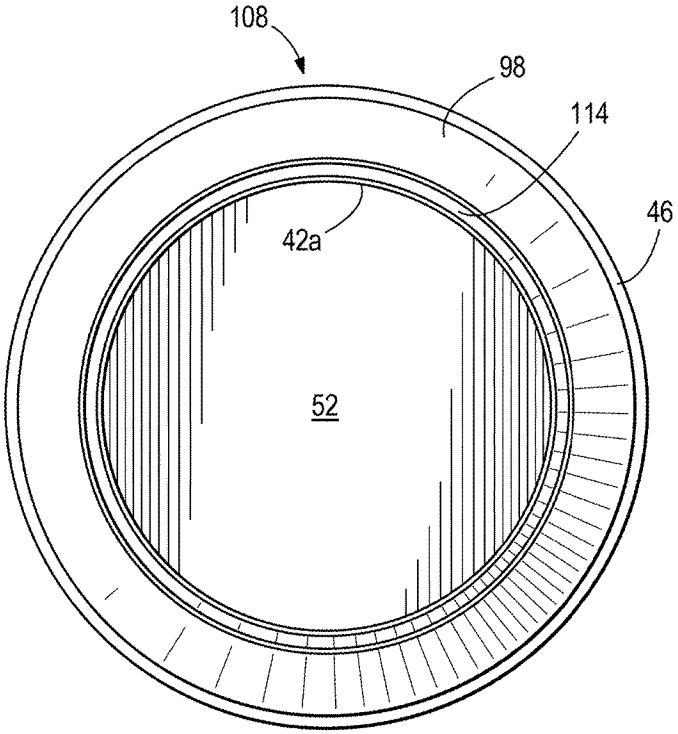
FIG. 11 is a bottom view of a finished overwrap container showing a uniform air gap between inner and outer walls of the overwrap container.

It is important to note that the particular application of the adhesive elements 74, 94 permit the connection of the overwrap 98 to the base container or cup 42 except along the entire length of the base container or cup side seam 58. However, the adhesive elements 74, 94 permit spacing of the overwrap 98 from the base container or cup 42 around the entire periphery thereof so that a uniform air gap 114 extends continuously between the overwrap 98 and the base container or cup 42 as seen in FIG. 11. The creation and maintenance of such a uniform air gap 114 improves over the prior art by providing an overwrap container 108 which is comfortable and convenient to hold around the entire periphery of the container 108.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims.

What is claimed is:

1. An overwrap container comprising:

a base container having a first side seam on a side wall that extends about a longitudinal axis to define an internal volume, and a bottom connected to the side wall, the first side seam being formed with overlapping opposite base container side edges which are heat sealed together;

a pre-glued overwrap positioned over the side wall of the base container, the overwrap having a second side seam aligned longitudinally with the first side seam, the second side seam being formed with overlapping opposite overwrap side edges which are joined together by an adhesive extending along substantially an entire length of one of the overwrap side edges; and connecting elements positioned between the side wall of the base container and the overwrap, and joining the side wall of the base container and the overwrap together except in an area along the aligned first and second side seams to define a uniform spacing extending continuously between the side wall and the overwrap forming an air gap therebetween.

2. The overwrap container of claim 1, wherein the connecting elements are formed of adhesive elements.

3. The overwrap container of claim 1, wherein the adhesive elements are formed from heated glue.

4. The overwrap container of claim 3, wherein the adhesive elements are formed as elongated spaced apart beads protruding outwardly from an outer periphery of the side wall.

5. The overwrap container of claim 4, wherein the beads extend generally parallel to each other.

6. The overwrap container of claim 1, wherein the overwrap extends completely around the side wall of the base container.

7. The overwrap container of claim 1, wherein the overwrap extends between a top edge of the base container and a bottom edge of the base container.

8. The overwrap container of claim 1, wherein the connecting elements are absent along entire lengths of the aligned first and second side seams.

9. A method for producing an overwrap container comprising the steps of:

a) providing a base container having a first side seam on a side wall that extends about a longitudinal axis to define an internal volume, and a bottom secured to the side wall, the first side seam being formed with overlapping opposite base container side edges which are heat sealed together;

b) providing the side wall of the base container with connecting elements around an outer periphery of the side wall except for an area along the first side seam; and c) providing a pre-glued overwrap having a second side seam over the side wall of the base container such that the first side seam of the base container and the second side seam are aligned together, and such that the overwrap is joined by the connecting elements to the outer periphery of the side wall of the base container except in an area along the aligned first and second side seams to define an overwrap container having a uniform spacing extending continuously between the side wall of the base container and the overwrap, the second side seam being formed with overlapping opposite overwrap side edges which are joined together by an adhesive extending along substantially an entire length of one of the overwrap side edges.

10. The method of claim 9, wherein the step b) includes applying a plurality of elongated adhesive beads protruding outwardly from the outer periphery of the side wall of the base container.

11. The method of claim 10, wherein the adhesive beads are applied with heated glue.

12. The method of claim 11, wherein the side wall of the base container and the overwrap are joined together once the heated glue has cooled.

13. The method of claim 10, wherein the adhesive beads are formed generally parallel to each other.

14. The method of claim 9, wherein step c) includes pressing the overlapped side edges together to form the second side seam.

15. The method of claim 9, wherein the connecting elements applied in step c) are absent along the complete length of the first side seam.

* * * * *